US011428061B2

(12) United States Patent
Telfer et al.

(10) Patent No.: US 11,428,061 B2
(45) Date of Patent: Aug. 30, 2022

(54) DOWNHOLE CUT AND PULL TOOL AND METHOD OF USE

(71) Applicant: ARDYNE TECHNOLOGIES LIMITED, Aberdeen (GB)

(72) Inventors: George Telfer, Aberdeen (GB); Michael Wardley, Aberdeen (GB); Alan Fair-Weather, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 1058 days.

(21) Appl. No.: 15/754,719

(22) PCT Filed: Sep. 16, 2016

(86) PCT No.: PCT/GB2016/052908
§ 371 (c)(1),
(2) Date: Feb. 23, 2018

(87) PCT Pub. No.: WO2017/046613
PCT Pub. Date: Mar. 23, 2017

(65) Prior Publication Data

US 2020/0224509 A1 Jul. 16, 2020

(30) Foreign Application Priority Data

Sep. 16, 2015 (GB) ..... 1516452

(51) Int. Cl.

| | |
|---|---|
| ***E21B 29/00*** | (2006.01) |
| ***E21B 23/01*** | (2006.01) |
| ***E21B 31/16*** | (2006.01) |
| ***E21B 31/20*** | (2006.01) |

(52) U.S. Cl.
CPC ..... *E21B 29/005* (2013.01); *E21B 23/01* (2013.01); *E21B 31/16* (2013.01); *E21B 31/20* (2013.01)

(58) Field of Classification Search
CPC ..... E21B 29/002; E21B 29/005; E21B 23/01; E21B 31/16; E21B 31/20
See application file for complete search history.

(56) References Cited

U.S. PATENT DOCUMENTS

| | | | | |
|---|---|---|---|---|
| 1,959,284 A | | 5/1934 | Clark et al. | |
| 2,117,594 A | | 5/1938 | Barrett | |
| 2,134,796 A | | 11/1938 | Osmun | |
| 2,481,637 A | * | 9/1949 | Yancey | E21B 31/16 166/55.1 |
| 4,047,568 A | * | 9/1977 | Aulenbacher | E21B 23/00 166/298 |
| 4,550,781 A | * | 11/1985 | Kagler, Jr. | E21B 29/12 166/340 |

(Continued)

FOREIGN PATENT DOCUMENTS

| | | |
|---|---|---|
| CN | 85109237 A | 7/1987 |
| CN | 103184850 B | 12/2015 |

(Continued)

*Primary Examiner* — David Carroll
(74) *Attorney, Agent, or Firm* — Law Office of Jesse D. Lambert, LLC

(57) ABSTRACT

The invention provides a downhole tool for cutting a wellbore casing. The downhole tool comprises a gripping mechanism for gripping a section of wellbore casing and a cutting mechanism configured to cut the casing. The grip mechanism is configured to grip a range of casing diameters.

15 Claims, 6 Drawing Sheets

(56) References Cited

U.S. PATENT DOCUMENTS

| | | | | |
|---|---|---|---|---|
| 4,969,514 | A * | 11/1990 | Morris | E21B 31/16 166/55.7 |
| 2010/0006290 | A1* | 1/2010 | Saylor, III | E21B 31/16 166/298 |
| 2010/0038080 | A1* | 2/2010 | McAfee | E21B 44/00 166/255.1 |
| 2014/0124191 | A1 | 5/2014 | Hallundbæk | |
| 2015/0354306 | A1* | 12/2015 | Fuller | E21B 17/1078 166/285 |

FOREIGN PATENT DOCUMENTS

| | | | |
|---|---|---|---|
| CN | 103562488 | B | 8/2016 |
| EP | 2530238 | A1 | 12/2012 |

* cited by examiner

DOWNHOLE CUT AND PULL TOOL AND METHOD OF USE

The present invention relates to a downhole tool and method of use, and in particular to downhole tubular cutting and pulling tools. A particular aspect of the invention relates to mechanisms to grip and cut a wellbore casing.

BACKGROUND TO THE INVENTION

In the course of constructing an oil or gas well, a hole is drilled to a pre-determined depth. The drilling string is then removed and a metal tubular or casing is run into the well and is secured in position using cement.

This process of drilling, running casing and cementing is repeated with successively smaller drilled holes and casing sizes until the well reaches its target depth. At this point, a final tubular or tubing is run into the well.

During production hydrocarbon flow through the tubing and are collected at surface. Over time, which may be several decades, the production of hydrocarbons reduces until the production rate is no longer economically viable, at which point the well has reached the end of its productive life. The well is plugged and abandoned.

It is often desirable to cut and remove casings which have been positioned in the wellbore. Conventional approaches to well casing removal involve multiple downhole trips to cut and remove the casing in individual stages. This can be a time consuming and expensive process.

The range of casing diameters used in the wellbore means that it is often necessary to return the tool to surface to change components of the tool to cut and grip sections of casings that have different diameters. This can be cumbersome and time-consuming.

SUMMARY OF THE INVENTION

It is an object of an aspect of the present invention to obviate or at least mitigate the foregoing disadvantages of prior art downhole cutting and pulling tools.

It is another object of an aspect of the present invention to provide a robust, reliable and compact downhole tool suitable for deployment downhole which is capable of adapting to different casing diameters such that the casing may be cut and removed quickly.

It is a further object of an aspect of the present invention to provide a downhole cutting and pulling tool with improved productivity or efficiency, or which is capable of reliably performing multiple casing gripping and cutting actions once deployed downhole.

Further aims of the invention will become apparent from the following description.

According to a first aspect of the invention there is provided a downhole tool comprising a gripping mechanism for gripping a section of wellbore casing; and a cutting mechanism configured to cut the casing;

wherein the grip mechanism is configured to grip a range of casing diameters.

By providing a gripping mechanism that is capable of engaging and gripping a range of casing diameters the tool may grip and cut a casing of a first diameter and grip and lift the casing at a position in the casing having a second diameter.

Preferably the downhole tool has a tool body. The tool body may have a through bore. Preferably the downhole tool is a cut and pull tool.

The downhole tool may be configured to grip the cut casing and the casing may be removed from the well bore by retrieving the tool from the wellbore.

The grip mechanism may be adjustably set to grip a range of casing diameters. Preferably the gripping mechanism comprises a cone and at least one slip.

The cone may be circumferentially disposed about a section of the downhole tool.

Preferably, the at least one slip is configured to engage the surface of the casing. Preferably, the at least one slip is configured to engage an inner diameter of a section of the casing. The at least one slip may bear against the cone to engage the casing.

Preferably the cone has a slope. The cone slope angle and/or the cone slope length may be adjusted and/or set to adjust and/or set the casing diameter grip range for the tool. The dimensions of the slip may be adjusted and/or set to adjust and/or set the casing diameter grip range for the tool.

The slips may travel along the slope of the cone so that the slips extend from the tool body to engage and grip the casing diameter.

In the case of a wider casing diameter the slips may travel further along the slope of the cone so that the slips extend further from the tool body to engage and grip the wider casing diameter. In the case of a narrower casing diameter the slips may travel a shorter distance along the slope of the cone so that the slips do not extend as far from the tool body to engage and grip the narrower casing diameter.

The relationship of the cone slope angle, length of the slope and the depth of the slips may be configured to allow the slips to engage casings of different diameters.

The cone and the at least one slip may be configurable to control the displacement of the at least one slip along the slope of the cone. The cone and slip may be configurable to control the displacement of the at least one slips outward from the tool body to engage the surface of casing.

Preferably, the gripping mechanism is located above the cutting mechanism when positioned in the wellbore. The gripping mechanism may comprise a sleeve configured to be slidably mounted within the tool body. The sleeve may be configured to move the at least one slip between a first position where the at least one slip does not engage the casing and a second position where the at least one slip engages the casing.

The gripping mechanism may be hydraulically or pneumatically actuated. The gripping mechanism may be actuated by pumping fluid into the tool. The gripping mechanism may be actuated by pumping fluid into a bore in the tool. The sleeve of the gripping mechanism may be configured to move in response to fluid pressure acting on the sleeve or at least part of the sleeve.

The gripping mechanism and the cutting mechanism may be axially spaced apart on the downhole tool to mitigate vibration effects or chattering on the downhole tool.

The gripping mechanism and the cutting mechanism may be axially spaced apart on the downhole by a distance of less than ten times the inside diameter of the wellbore casing.

The gripping mechanism and the cutting mechanism may be axially spaced apart on the downhole by a distance of less than five times the inside diameter of the wellbore casing.

The gripping mechanism and the cutting mechanism may be axially spaced apart on the downhole by a distance of less than two times the inside diameter of the wellbore casing.

By providing a gripping mechanism and cutting mechanism in such close proximity the structural integrity of the knives may be preserved and their life span extended by avoiding damage due to vibration of the tool. The close proximity of the gripping mechanism to the cutting mechanism provides a secure hold and prevents chattering when the knives engage and start to cut the casing. This may allow the tool to perform a number of downhole cutting tasks in a single trip without having to return to surface for knife and/or tool repairs.

The gripping mechanism may be resettable for positioning and gripping the casing at multiple locations within the wellbore.

The gripping mechanism may comprise a lock mechanism to prevent accidental release of the gripping mechanism. The lock mechanism may have a controlled release to allow the grip mechanism to disengage from the casing. The lock mechanism may comprise an unlock mechanism to allow the grip mechanism to disengage from the casing.

The cutting mechanism may comprise at least one blade or knife.

Preferably the cutting mechanism comprises a plurality of knives. The plurality of knives may be circumferentially disposed about a section of the downhole tool.

The cutting mechanism may comprise a sleeve configured to be slidably mounted within the tool body. The sleeve may be configured to move the knives between a storage position where the knives are retracted and do not engage the casing and an operational position where the knives are extended and engage the casing.

The cutting mechanism may be hydraulically or pneumatically actuated. The cutting mechanism may be actuated by pumping fluid into the tool. The cutting mechanism may be actuated by pumping fluid into a bore in the tool. The sleeve of the cutting mechanism may be configured to move in response to fluid pressure acting on the sleeve or at least part of the sleeve.

A fluid displacement member may be disposed in a throughbore of the tool body and may be configured to introduce a pressure difference in the fluid upstream of the displacement member and the fluid downstream of the displacement member.

The fluid displacement member may provide a restriction and/or nozzle in a flow path in the tool body. The fluid displacement member may form a venturi.

The downhole tool may comprise a venturi. The downhole tool may comprise a venturi flow path. Preferably the cutting mechanism comprises a venturi flow path. The venturi flow path may be axially moveable in the tool body. The downhole tool may comprise a venturi-shaped flow path. The venturi flow path may be configured to accelerate fluid flow through the tool body and/or cutting mechanism.

The fluid displacement member may be disposed in the venturi flow path and may be configured to introduce a pressure difference in the fluid upstream of the displacement member and the fluid downstream of the displacement member.

Fluid flow in the venturi flow path may provide a driving force to actuate the cutting mechanism.

The venturi flow path may be configured to move cuttings further downhole when fluid is passed through the venturi flow path.

The downhole tool may comprise a mechanism configured to provide a change in the fluid circulation pressure when the knives are deployed and/or a cutting operation complete. The fluid displacement member may be configured to provide a change in the fluid circulation pressure when the knives are deployed and/or a cutting operation complete. The pressure change may be an increase or a decrease in pressure.

The cutting mechanism may comprise a recirculating flow system arranged to direct flow and/or casing cuttings created by the cutting operation to a location away from the cutting site. The location away from the cutting site may be further down the annulus between the downhole tool and the casing being cut.

The recirculating flow path may comprise a first flow path extending between a throughbore in the tool body and the annulus of the wellbore. The recirculating flow path comprises a second flow path extending between the throughbore of the tool body and an opening on a lower end of the tool body, an opening on a lower hydraulically operable tool and/or an opening on a lower tool string component.

The first flow path and the second flow path may be in fluid communication in a channel in the tool body. Preferably the first flow path and the second flow path are configured such that fluid flowing through the first flow path draws fluid through the second flow path.

Preferably fluid flowing through first flow path actuates the cutting mechanism. The sleeve of the cutting mechanism may be configured to move in response to fluid flowing through first flow path and acting on the sleeve or at least part of the sleeve.

The differential pressure caused by the venturi effect entrains fluid to flow along the second pathway or flow path through the filter where it flows into the first pathway or flow path.

The downhole tool may comprise a bypass flow path around the cutting mechanism. Preferably the bypass flow path is selectively openable and/or closable.

The tool may comprise a receptacle provided to collect the casing cuttings. The receptacle may facilitate the transportation of the cuttings back to surface. The receptacle may be connected to the tool and the cutting may be recovered when the tool is recovered from the well.

The tool may comprise a resettable gripping mechanism for gripping on the inside diameter of a first section of casing, wherein said gripping mechanism may be released and reset inside a second section of casing of a different inside diameter to the first casing during the same trip in the well.

The gripping mechanism may be configured to grip a casings diameter range differing by more than 2%.

The gripping mechanism may be configured to grip a casings diameter range differing by more than 5%.

The gripping mechanism may be configured to grip a casings diameter range differing by more than 10%.

Upper and lower fluid pressure thresholds may be set to control the activation of the gripping mechanism and/or the cutting mechanism.

According to a second aspect of the invention there is provided a method of cutting a wellbore casing comprising providing a downhole tool comprising a gripping mechanism for gripping a section of wellbore casing; and a cutting mechanism configured to cut the casing;

wherein the grip mechanism is configured to grip a range of casing diameters;

lowering the downhole tool into a wellbore to a first desired depth;

actuating the grip mechanism to grip the casing;

actuating the cutting mechanism to cut the casing; and removing the cut casing section from the wellbore.

The method may comprise actuating the grip mechanism by pumping a fluid into a bore in the downhole tool.

The method may comprise actuating the cutting mechanism by pumping a fluid into a bore in the downhole tool and rotating the cutting mechanism to cut the casing. The cutting mechanism may be rotated by rotating a tool string connected to the downhole tool.

The method may comprise releasing the grip mechanism from the casing after the casing has been cut and raising the downhole tool into a wellbore to a second desired depth. The method may comprise actuating the grip mechanism to grip the casing at the second desired depth and pulling the downhole tool toward the surface to remove the casing from the wellbore. The diameter of the casing at the second desired depth may be different to the casing diameter at the first desired depth.

The method may comprise a further cutting step if the casing remains immovable due to cement between the casing and the wellbore or a blockage. The method may comprise moving the downhole tool into a wellbore to a further desired depth. The further desire depth may be closer to the surface in the wellbore than the first desired depth. The method may comprise actuating the grip mechanism to grip the casing at the further desired depth and actuating the cutting mechanism to cut the casing.

The method may comprise pulling the downhole tool towards the surface when the grip mechanism is gripping the casing to check for movement of the casing. The method may comprise pulling the downhole tool towards the surface during the cutting of the casing. The method may comprise monitoring the fluid pressure circulating through the downhole tool. The method may comprise deactivating the cutting mechanism based on the monitored fluid pressure level circulating through the downhole tool.

The method may comprise monitoring the force required to rotate the cutting mechanism.

The method may comprise adjusting a cone slope angle and/or a cone slope length in the gripping mechanism to adjust the casing diameter grip range of the tool.

The method may comprise adjusting the dimensions of the at least one slip in the gripping mechanism to adjust the casing diameter grip range of the tool.

Embodiments of the second aspect of the invention may include one or more features of the first aspect of the invention or its embodiments, or vice versa.

According to a third aspect of the invention there is provided a method of cutting a wellbore casing comprising providing a downhole tool comprising a gripping mechanism for gripping a section of wellbore casing; and a cutting mechanism configured to cut the casing;

wherein the grip mechanism is configured to grip a range of casing diameters;

lowering the downhole tool into a wellbore to a first desired depth;

actuating the grip mechanism to grip the casing;

actuating the cutting mechanism to cut the casing;

moving the downhole tool to a second desired depth and removing the cut casing section from the wellbore.

The method may comprise actuating the grip mechanism to grip a casing of different diameter at the second desired depth.

Embodiments of the third aspect of the invention may include one or more features of the first or second aspects of the invention or their embodiments, or vice versa.

According to a fourth aspect of the invention there is provided a method of operating a cutting and pulling downhole tool comprising providing a downhole tool comprising a gripping mechanism for gripping a section of wellbore casing; and a cutting mechanism configured to cut the casing;

wherein the grip mechanism is configured to grip a range of casing diameters;

lowering the downhole tool into a wellbore to a first desired depth;

actuating the grip mechanism to grip the casing;

actuating the cutting mechanism to cut the casing and removing the cut casing section from the wellbore.

The method may comprise actuating the grip mechanism by pumping a fluid into a bore in the downhole tool.

The method may comprise actuating the grip mechanism and/or cutting mechanism by pumping a fluid into a bore in the downhole tool The method may comprise actuating the cutting mechanism by rotating the cutting mechanism to cut the casing. The cutting mechanism may be rotated by rotating a tool string connected to the downhole tool.

The method may comprise releasing the grip mechanism from the casing after the casing has been cut and raising the downhole tool into a wellbore to a second desired depth. The method may comprise actuating the grip mechanism to grip the casing at the second desired depth and pulling the downhole tool toward the surface to remove the casing from the wellbore. The diameter of the casing at the second desired depth may be different to the casing diameter at the first desired depth. The method may comprise actuating the grip mechanism to grip a casing of different diameter at the further desired depth.

The method may comprise a further cutting step if the casing remains immovable due to cement between the casing and the wellbore or a blockage. The method may comprise moving the downhole tool into a wellbore to a further desired depth. The further desire depth may be closer to the surface in the wellbore than the first desired depth. The method may comprise actuating the grip mechanism to grip the casing at the further desired depth and actuating the cutting mechanism to cut the casing.

The method may comprise pulling the downhole tool towards the surface when the grip mechanism is gripping the casing to check for movement of the casing. The method may comprise pulling the downhole tool towards the surface during the cutting of the casing. The method may comprise monitoring the fluid pressure circulating through the downhole tool. The method may comprise deactivating the cutting mechanism based on the monitored fluid pressure level circulating through the downhole tool.

The method may comprise monitoring the force required to rotate the cutting mechanism. The method may comprise pumping fluid through a venturi flow path in the downhole tool. The method may comprise pumping fluid through a venturi flow path and/or a recirculation flow path to move cuttings further downhole.

The differential pressure caused by the venturi effect entrains fluid to flow along the second pathway or flow path through the filter where it flows into the first pathway or flow path.

The method may comprise adjusting a cone slope angle and/or a cone slope length in the gripping mechanism to adjust the casing diameter grip range of the tool.

The method may comprise adjusting the dimensions of the at least one slip in the gripping mechanism to adjust the casing diameter grip range of the tool.

Embodiments of the fourth aspect of the invention may include one or more features of any of the first, second or third aspects of the invention or their embodiments, or vice versa.

According to a fifth aspect of the invention there is provided a downhole tool comprising a tool body;

a gripping mechanism configured to grip a range of casing diameters; and a cutting mechanism configured to cut the casing;

wherein the cutting mechanism comprises a venturi flow path configured to move cuttings from a cutting site.

Preferably the venturi flow path is configured to move cuttings when fluid is passed through the venturi flow path.

Preferably the venturi flow path is configured to move cuttings further downhole.

Embodiments of the fifth aspect of the invention may include one or more features of any of the first to fourth aspects of the invention or their embodiments, or vice versa.

According to a sixth aspect of the invention there is provided a downhole tool comprising a tool body;

a gripping mechanism configured to grip a range of casing diameters; and a cutting mechanism configured to cut the casing; and a bypass flow path around the cutting mechanism;

wherein the cutting mechanism comprises a venturi flow path configured to move cuttings downhole;

wherein the bypass flow path and/or the venturi flow path are selectively operable.

Embodiments of the sixth aspect of the invention may include one or more features of any of the first to fifth aspects of the invention or their embodiments, or vice versa.

According to a seventh aspect of the invention there is provided a downhole tool comprising a tool body;

a gripping mechanism configured to grip a range of casing diameters; and a cutting mechanism configured to cut the casing; and a bypass flow path around the cutting mechanism;

wherein the cutting mechanism comprises a first flow path configured to be in fluid communication with the cutting mechanism;

wherein the bypass flow path and/or the first flow path are selectively operable.

Preferably the downhole tool is configured such that fluid flowing through the first flow path actuates the cutting mechanism.

The bypass flow path and/or the first flow path may be selectively openable and/or closable. Preferably the bypass flow path is open when the first flow path is closed. Preferably the first flow path is open when the bypass flow path is closed.

Embodiments of the seventh aspect of the invention may include one or more features of any of the first to sixth aspects of the invention or their embodiments, or vice versa.

According to an eighth aspect of the invention there is provided a downhole tool comprising a tool body;

a gripping mechanism configured to grip a range of casing diameters; and a cutting mechanism configured to cut the casing; and a bypass flow path around the cutting mechanism;

wherein the cutting mechanism comprises a first flow path comprising a venturi flow path;

wherein the bypass flow path and/or the first flow path are selectively operable.

Preferably the first flow path is configured to create a venturi effect to move cuttings downhole.

The bypass flow path and/or the first flow path may be selectively openable and/or closable.

Embodiments of the eighth aspect of the invention may include one or more features of any of the first to seventh aspects of the invention or their embodiments, or vice versa.

According to a ninth aspect of the invention there is provided a method of cutting a section of a wellbore casing comprising providing a downhole tool comprising a tool body;

a gripping mechanism configured to grip a range of casing diameters; and a cutting mechanism configured to cut the casing;

wherein the cutting mechanism comprises a venturi flow path;

lowering the downhole tool into a wellbore to a first desired depth;

actuating the grip mechanism to grip the casing;

actuating the cutting mechanism to cut the casing;

pumping fluid through the venturi flow path to move cuttings from a cut site; and removing the cut casing section from the wellbore.

Embodiments of the ninth aspect of the invention may include one or more features of any of the first to eighth aspects of the invention or their embodiments, or vice versa.

According to a tenth aspect of the invention there is provided a method of cutting a wellbore casing comprising providing a tool string comprising a downhole tool, the downhole tool comprising a gripping mechanism configured to grip a range of casing diameters;

a cutting mechanism configured to cut the casing; and a bypass flow path around the cutting mechanism;

lowering the tool string into a wellbore to a first desired depth;

actuating the grip mechanism to grip the casing;

pumping fluid through the bypass flow path;

actuating the cutting mechanism to cut the casing; and removing the cut casing section from the wellbore.

Embodiments of the tenth aspect of the invention may include one or more features of any of the first to ninth aspects of the invention or their embodiments, or vice versa.

According to an eleventh aspect of the invention there is provided a method of cutting a wellbore casing comprising providing a tool string comprising a downhole tool and at least one hydraulically actuable tool, the downhole tool comprising a gripping mechanism configured to grip a range of casing diameters;

a cutting mechanism configured to cut the casing; and a bypass flow path around the cutting mechanism;

a first flow path in fluid communication with the cutting mechanism;

lowering the tool string into a wellbore to a first desired depth;

actuating the grip mechanism to grip the casing;

pumping fluid through the bypass flow path to actuate the at least one hydraulically actuable tool;

closing the bypass flow path and opening the first flow path actuating the cutting mechanism to cut the casing; and removing the cut casing section from the wellbore.

By pumping fluid through the bypass flow path fluid may flow through the downhole tool to actuate the at least one hydraulically actuable tool.

The at least one hydraulically actuable tool may be selected from a drill, mill, packer, bridge plug, hydraulic disconnects, whipstock, hydraulic setting tools or perforating gun.

The method may comprise dropping a ball to close the bypass flow path and open the first flow path.

Embodiments of the eleventh aspect of the invention may include one or more features of any of the first to tenth aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

The tool is used in a well borehole lined with a well casing. It will be appreciated that this is only an example use and the tool may be used in other applications in gripping and cutting tubular structures.

Figure 1A:
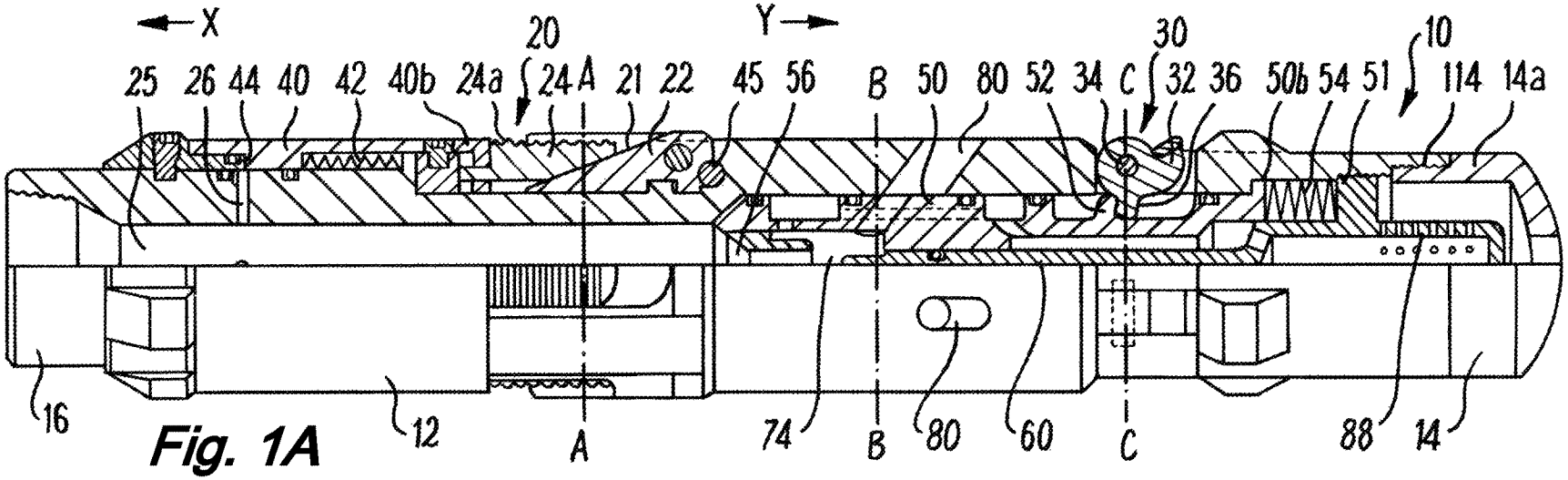
FIG. 1A is a longitudinal view through the downhole tool in a deployed state according to an embodiment of the invention.
Figure 2A:
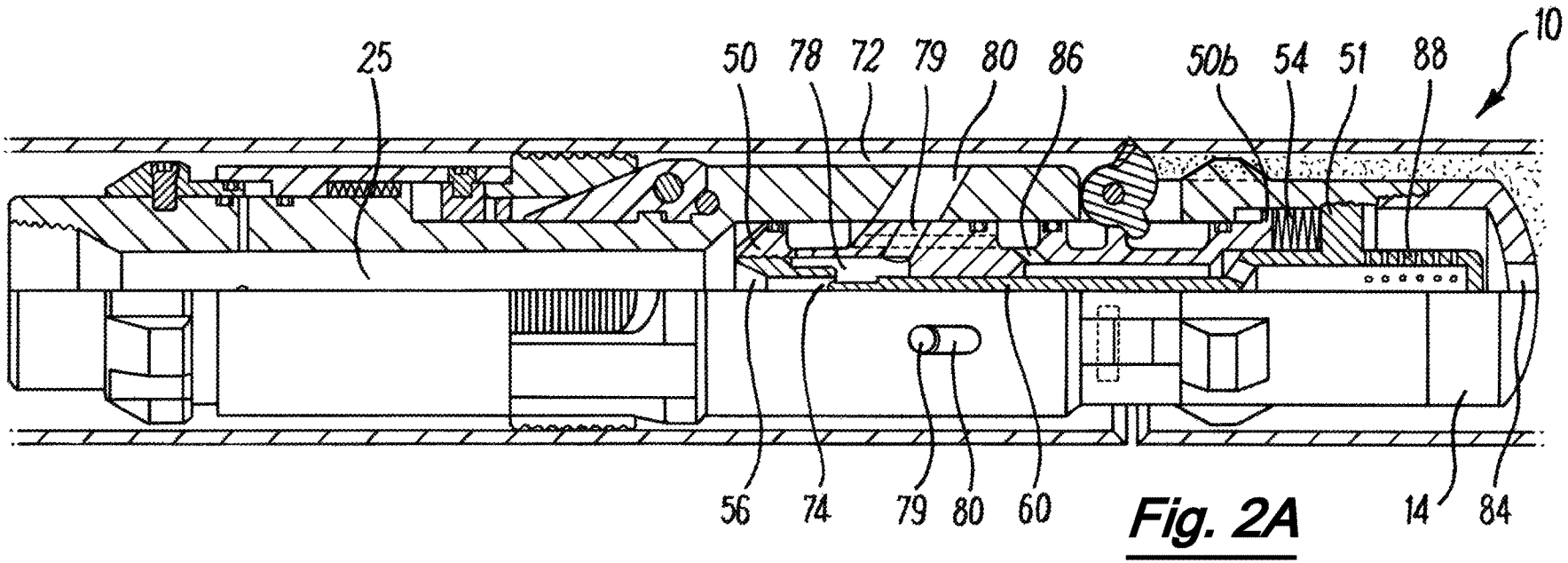
FIG. 2A is a longitudinal section through the downhole tool of FIG. 1A shown in an operational state.

FIGS. 1A and 2A are sectional views of a downhole tool in accordance with a first embodiment of the invention in different phases of operation.

FIG. 1A is a longitudinal section through the downhole tool 10. The downhole tool 10 has an elongate body 12 with a first end 14 and a second end 16. The first end 14 is designed for insertion into the wellbore first. The second end 16 is configured to be coupled to a tool string. The tool body 12 comprises a gripping mechanism 20 to secure the tool within the wellbore casing and a cutting mechanism 30 configured to cut the casing.

The gripping mechanism 20 comprises a cone 22 circumferentially disposed about a section of the downhole tool 10. FIG. 1B shows a cross-section of line A-A' of FIG. 1A. A plurality of slips 24 are configured to move along the surface of the cone 22. The slips 24 have a grooved or abrasive surface 24*a* on its outer surface to engage and grip the casing.

The slips 24 are configured to move between a first position shown in FIG. 1A on the cone 22 in which the slips 24 are positioned away from surface of the casing, and a second position in which the slips 24 engage the surface of the casing as shown in FIG. 2A. The slope angle and slope length of the cone 22 may be configured to enable the slips to engage a range of casing diameters.

The slips 24 are connected to a sleeve 40. The sleeve 40 is movably mounted on the body 12 and is biased in a first position by a spring 42 as shown in FIG. 1A. In this example the spring is a wave spring. However, it will be appreciated that any spring, compressible member or resilient member may be used to bias the sleeve in a first position.

The downhole tool comprises a bore 25 through which fluid is configured to be pumped. A shoulder 44 of the sleeve 40 is in fluid communication with the main tool bore 25 via a pathway/flow path 26. The sleeve 40 is configured to move from a first sleeve position shown in FIG. 1A to a second fluid position shown in FIG. 2A when fluid is pumped into bore 25 through pathway/flow path 26 and fluid pressure is applied to shoulder 44 of the sleeve 40.

The level of fluid pressure applied to the tool may have a set upper and lower threshold such that the spring force of spring 42 may overcome the lower threshold. The upper threshold may be the minimum pressure required to overcome the spring force of spring 42.

The gripping mechanism is configured to hold the downhole tool including the cutting mechanism steady in the wellbore and prevent chattering or vibration of the tool during cutting of the casing. Vibration or chattering of the tool and/or the cutting mechanism may damage the tool, the cutting mechanism and/or the knives.

The axial distance between the gripping mechanism and the cutting mechanism is less than ten times the inside diameter of the wellbore casing. The close proximity of the gripping mechanism and the cutting mechanism mitigates the vibration effect of the cutting operation. In other embodiments the gripping mechanism and the cutting mechanism may be axially spaced apart on the downhole by a distance of between two and twenty times the inside diameter of the wellbore casing.

A bearing 45 on the downhole body 12 connects the grip mechanism 20 with the cutting mechanism 30. The gripping mechanism 20 is rotatably mounted on the body and is configured to secure the tool against the wellbore casing. Slip rings (not shown) between the sleeve 40, cone 22 and slips 24 allow the grip mechanism 20 to remain stationary and grip the casing whilst the cutting mechanism 30 is rotated via a rotating tool string to cut the casing.

Figure 1D:
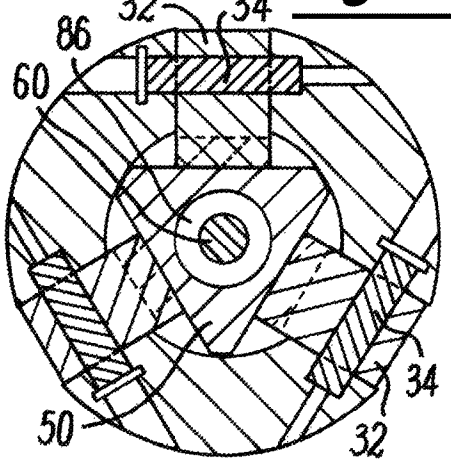
FIGS. 1B to 1D are enlarged sectional views of sections A'A, B to B' and C to C' of the downhole tool of FIG. 1A.
Figure 1C:
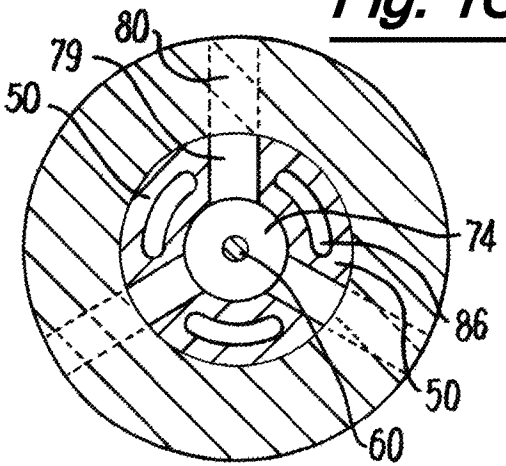
Figure 1B:
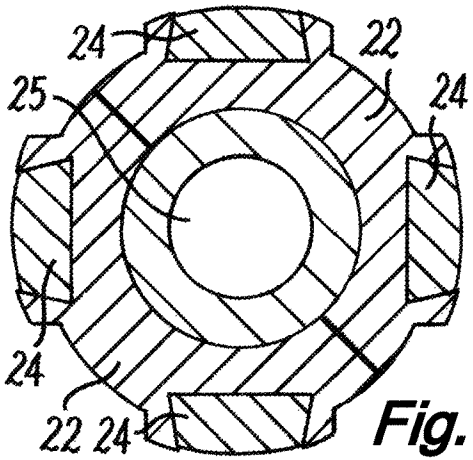

FIG. 1D shows a cross-section view of line C-C' of FIG. 1A. As shown in FIGS. 1A, 1D and 2A the cutting mechanism 30 comprises a plurality of knives 32 which are configured to engage the casing 18 to cut the casing. The knives 32 are mounted on pivot 34 and are configured to move between a storage position where the knives are retracted shown in FIG. 1A and an operational position where the knives are deployed shown in FIG. 2A.

An annular sleeve 50 is slidably mounted in the bore 25. The sleeve 50 is configured to move axially between a first position shown in FIG. 1A and second position shown in FIG. 2A. Although it is shown to move to a second position in FIG. 2A, intermediate positions may be selected. The sleeve 50 comprises a shoulder 52 which is configured to engage with a pivot arm 36 connected to the cutting knife 32. The shoulder 52 of the sleeve 50 is configured to pivotally move the knives 32 between a knife storage position shown in FIG. 1A and an operational position shown in FIG. 2A.

Although the above example describes actuation of the cutting knives. It will clear that alternative mechanisms may be used including springs, levers, cams, cranks, screws, gears, pistons and/or pulleys. The gears may include spur, rack and pinion, bevel and/or worm gears.

FIG. 10 shows a cross-section view of line B-B' of FIG. 1A. FIGS. 1A and 10 show a fluid displacement member 60 is disposed in the bore 25 and is configured to introduce a pressure difference in the fluid upstream of the displacement member and the fluid downstream of the displacement member 60.

The annular sleeve 50 is movably mounted in the tool and is biased in a first position by a spring 54 located between one end of the sleeve 50*b* and a spring retainer mount 51. In this example the spring is a disc spring. However, it will be appreciated that any spring, compressible member or resilient member may be used.

Figure 2B:
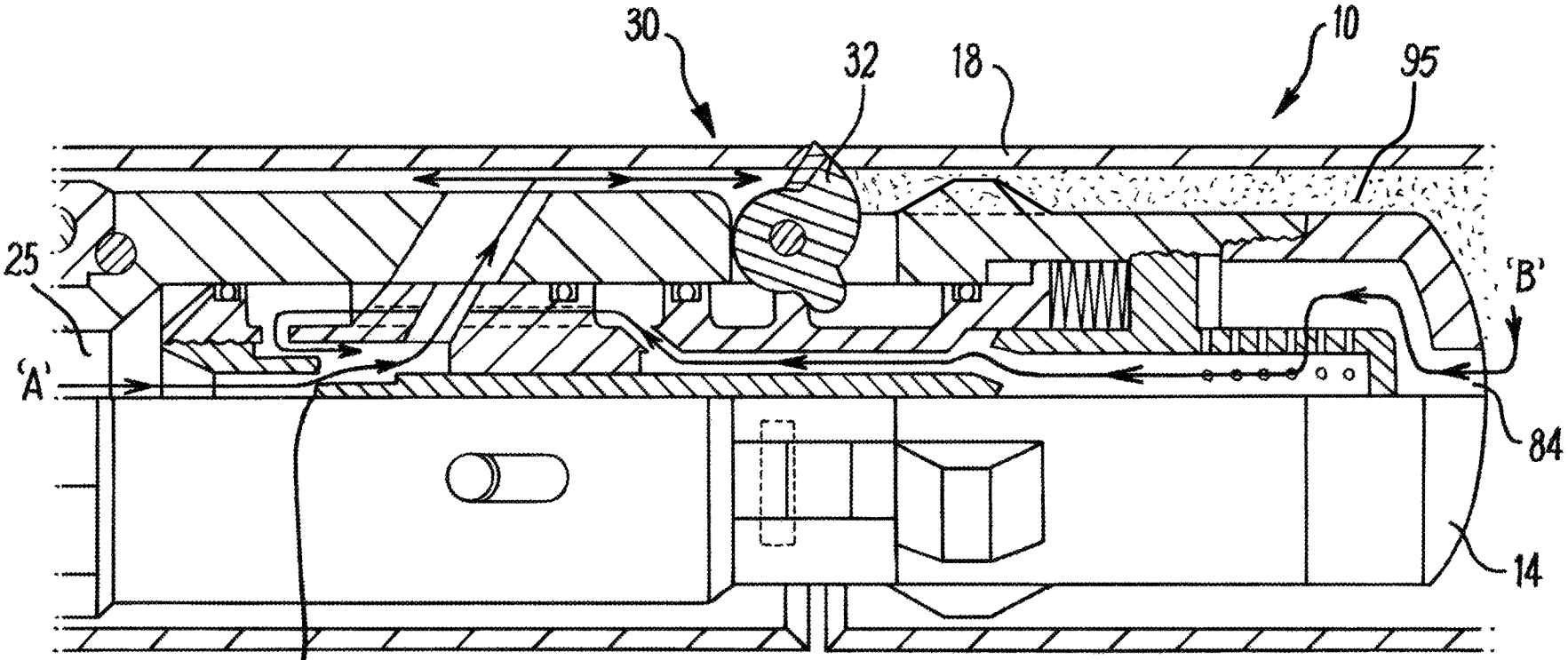
FIG. 2B is an enlarged view of a section of the downhole tool of FIG. 2A showing fluid flow paths through the tool.

The bore 25 is in fluid communication with the annular space 72 through a first flow path denoted by arrow "A" in FIG. 2B. The nozzle 74 formed between the sleeve 50 and the displacement member 60 is an inlet to the first flow path. The first flow path passes through a channel 78 located between the sleeve 50 and the displacement member 60, a port 79 in the sleeve 50 and through an outlet 80 in the body 12 and into the annular space 72. The fluid displacement member 60 acts to direct the fluid into channel 78.

The sleeve 50 is configured to be moved from a first sleeve position shown in FIG. 1A to a second sleeve position shown in FIG. 2A when fluid pressure is applied to shoulder 56 of the annular sleeve 50.

In FIG. 1A the annular sleeve 50 is in a first position which is its outermost extended position from the flow displacement member 60. When fluid pressure applied to shoulder 56 is sufficient to overcome the spring force of spring 54 the sleeve 50 moves toward the first end 14 of the tool. The fluid displacement member 60 remains stationary.

The level of fluid pressure applied to the tool may have a set upper and lower threshold such that the spring force of spring 54 may overcome the lower threshold. The upper threshold may be the minimum pressure required to overcome the spring force of spring 54.

In FIGS. 2A and 2B the annular sleeve is located in a second position wherein the flow area of the nozzle 74 is reduced by the movement of the sleeve 50. The reduced flow area increases the fluid pressure through the nozzle 74. Measuring and/or monitoring the fluid pressure through the nozzle 74 may provide an indication of the movement of the annular sleeve 50 and the movement of the knives to a cutting operational position as shown in FIG. 2A. The pressure may increase or decrease when the knives are moved to a cutting operational position.

FIG. 2B shows that the down hole tool comprises a second flow path denoted by arrow "B". The fluid inlet of the second flow path is port 84 located on the first end 14 on the body.

The second pathway/flow path passes through a channel 86 in the annular sleeve 50 and into a channel 78 located between the sleeve 80 and the displacement member 70. In channel 78 the fluid from the second flow path joins the fluid passing through the first flow path. The fluid exits the tool body into the annular space 72 via port 79 in the sleeve 50 and through an outlet 80 in the body 12 and into the annular space 72.

The second pathway/flow path comprises a screen 88 to prevent casing cutting and solids from entering the downhole tool via the second flow path.

The first flow path and the second flow path are in fluid communication in channel 78 located between the sleeve 50 and the displacement member 60. Fluid flowing through channel 78 along the first flow path induces a venturi effect in the second flow path denoted by arrow "B" in FIG. 2B and draws fluid through the second flow path.

Fluid flow through the first flow path directs fluid flow into the annular space 72. As the flow through the first flow path creates a venturi effect in the second flow path and induces fluid flow in the second flow path from the wellbore through the inlet 84 it creates a localised recirculation of fluid. The recirculation of fluid directs the flow of fluid from the outlet 80 which entrains cuttings 95 during the cutting operation and moves the fluid and cuttings further downhole toward the first end 14 of the tool. This action allows the cuttings to be moved downhole away from the cutting site.

The outlet 80 is dimensioned such that it is larger than the port 79 on the sleeve 50. This is to ensure that fluid flow through port 79 and outlet 80 is maintained as the sleeve moves between the first and second positions shown in FIGS. 1A and 2. This provides an axially moveable venturi flow path which moves as the axial position of the sleeve 50 moves.

The moveable venturi flow path may provide an additional driving force to assist the movement of the sleeve to extend the knives.

The moveable venturi flow path may provide a driving force to actuate the cutting mechanism and induces localised recirculation of fluid around the tool to ensure that the casing cuttings are removed from the cutting site.

Figure 3:
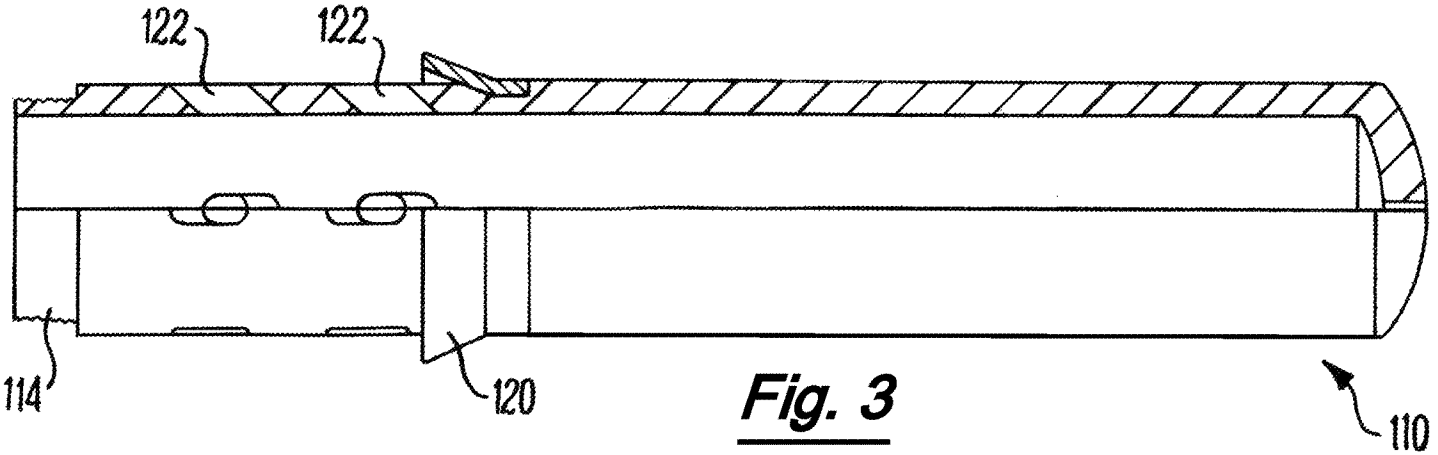
FIG. 3 is a schematic view of cutting collection device that is attached to the downhole tool of FIG. 1A.

Optionally the tool may comprise a cutting collection device 110 as shown in FIG. 3. The bull nose 14*a* of the end section 14, may be removed via threads 114 and replaced with the cutting collection device shown in FIG. 3. The cutting collection device has a skirt 120 generally circumferentially arranged around the device made of a flexible material which is configured to contact the inner casing surface. The cutting collection device has a number of fluid inlet ports 122 to facilitate fluid and casing cuttings entry. By providing the collection device the cuttings damage to the tool or blockage by the cuttings is avoided.

The collection of cuttings provides evidence that the cutting operation was performed as part of a differential diagnosis in the event that the casing removal procedure was unsuccessful.

Operation of the apparatus will now be described with reference to FIGS. 1A, 2A and 2B. In FIG. 1A, the cutting and pulling downhole tool 10 is shown in a deployment phase, with a grip mechanism 20 in a first position and a cutting mechanism 30 in a retracted storage position. The tool 10 in the deployment phase is lowered in the downhole to a desired position where the casing is to be cut.

Once the tool is at a desired position in the wellbore a fluid pressure is applied within the work string. Fluid travels through bore 25 and pathway/flow path 26 and fluid pressure acts on shoulder 44 of the sleeve 40 in the grip mechanism 20. When the fluid pressure overcomes the spring force of spring 42 the sleeve moves along the longitudinal axial of the tool body 12 to the second position shown in FIG. 2A. The slips 24 which are in contact with the end 40*b* of the sleeve 40 are pushed along the slope 21 of cone 22. Due to the length and angle of slope 21 of cone 22 the slips extend outward and engage the surface of casing 18. The angle of the cone slope, length of the slope and the depth of the slips may be configured to allow the slips to engage and grip casings of different inner diameters.

The slips provide friction to maintain the position of the tool within the casing as the tool cuts the casing. The length and angle of the slope 21 allow the slips to extend gradually. The length and angle of the slope 21 and the depth of the slips allow slips to engage and grip a wide range of casing diameters.

The axially position of the tool is maintained by latching the grip mechanism 20. To latch the grip mechanism in a grip position an upward force is applied to the tool as shown by arrow X in FIG. 1A. The tension or pulling force causes the slips to be wedged or locked between the surface of the cone 22 of the tool and the casing 18 of the wellbore. At this point the tool will remain at this location even if the fluid pressure in the bore 25 is reduced or stopped. The upward force applied to the tool may also apply pressure to the bearing 45 and may facilitate the rotation on the cutting mechanism during the cutting operation.

If the grip mechanism 20 was not latched the grip mechanism would revert to its first position shown in FIG. 1A when the fluid pump was stopped. The absence of fluid pressure would result in the spring force of spring 42 moving the sleeve 40 to the first position shown in FIG. 1A. The slips 24 which are in contact with the end 40*b* of the sleeve 40 would be pulled along the slope 21 of cone 22 and moved away from the surface of casing 18.

The fluid pumped into bore 25 also acts against shoulder 56 of the sleeve 50 of the cutting mechanism. When the fluid pressure is sufficient to overcome the spring force of spring 54 the sleeve 50 is moved towards end 14 of the downhole tool. Axial movement of the sleeve 50 towards first end 14 of the tool causes shoulder 52 of the sleeve 50 to acts against the pivot arm 36 to rotate the knife 32 from a retracted storage position to an extended operational position.

The fluid pressure supply to the bore 25 is maintained during the cutting operation. The tool string connected to the downhole tool is rotated to rotate the cutting knife to cut the casing.

During the cutting operation the grip mechanism remains substantially stationary relative to the cutting mechanism. The bearings 45 allow the cutting mechanism to rotate whilst the grip mechanism 20 securely holds the tool within the wellbore casing.

The fluid flows from the bore 25 through nozzle 74 and through the first flow path into the annular space. Cuttings produced during the cutting operation are carried further downhole in the annular space between the cutting mechanism and the casing by the local recirculation flow of fluid through the first pathway/flow path into the annular space. The flow is recirculated through the tool via the first and second flow paths. The flow through the first flow path induces flow through the second flow path in accordance with the venturi effect.

Cuttings 95 are entrained in the flowing fluid and are diverted further downhole into the annular space. Wellbore fluid is drawn into the second flow path through port 84 in the first end section 14 and up through the tool as shown by arrow "B" in FIG. 2B. A screen 88 functions to filter solid particles such as casing cutting or solids. Optionally the tool may have a collector device 110 to allow collection of the cuttings or solids to be collected and removed from the well bore.

Fluid flowing in the second flow path exits into the first flow path. In this configuration, the arrangement of the first and second flow paths allows a recirculation of fluid.

The casing cuttings are collected in a manner which allows them to be removed from the wellbore and avoids blockages or damage to wellbore equipment.

When the cutting mechanism has finished cutting the casing, the cutting mechanism is deactivated. The rotation the tool string is stopped to stop the rotation of the cutting mechanism. Optionally, the fluid pump is deactivated. The absence of fluid pressure on the shoulder 56 of the sleeve 50 causes the spring force of spring 54 to act on the sleeve to move the sleeve to the first position shown in FIG. 1A. The sleeve 50 is moved in a generally upward direction. The shoulder 36 on the sleeve allows the pivot arm to pivot the knife 32 to a retracted storage position.

After the casing is cut, the cut casing section may be removed from the wellbore. It is difficult to know when the cutting operation has been completed. There are a number of indicators that suggest that the casing has been cut. A pressure increase measured at nozzle 74 indicates that the sleeve 50 has been moved and that knives 32 have been successfully deployed to an extended operational position.

Another indicator is a change in the force required to rotate the cutting mechanism. This suggests that the casing has been cut and the resistance against the knives is reduced. A further method of determining whether the casing has been cut is to apply an upward force on the tool while it is still gripping the casing. If there is movement of the casing the cut has been successful.

It is possible to lift the cut casing section with the downhole tool located at the cut section of the casing. As the grip mechanism of the tool maintains grip on the casing retraction of the downhole tool lifts the cut casing section from the wellbore. However, it is preferably to relocate the tool to a higher position closer to the surface within the wellbore before attempting to lift and remove the casing from the wellbore.

In order to relocate the downhole tool to a different axial position in the wellbore the fluid pump is switched off and fluid is no longer pumped through the bore 25 of the downhole tool. The absence of fluid pressure on the shoulder 44 of sleeve 40 causes the spring force of spring 42 to act on sleeve 40 to move the sleeve to the first position shown in FIG. 1A. However, the spring force of spring 42 may not be sufficient to move the slips 24 which are located in a latched position locked between the compressive forces of the casing and the cone 22.

To unlatch and release the slips 24 a downward force is applied in the direction shown as "Y" in FIG. 1A which momentarily moves the cone 22 away from the slips 24 which is sufficient to allow the spring force of the spring 42 to pull the slips 24 along the slope 21 of the cone and away from the casing to the first position shown in FIG. 1A.

The downhole tool may be relocated to a new position and the gripping mechanism may grip the casing as described above. It is possible that the casing diameter of the new axial position is different to the casing diameter where the cutting operation was performed. In the case of a wider casing diameter the slips 24 will travel further along the slope 21 of the cone 22 so that the slips extend further from the tool body to engage and grip the wider casing diameter. In the case of a narrower casing diameter the slips 24 will travel a shorter distance along the slope 21 of the cone 22 so that the slips do not extend as far from the tool body to engage and grip the narrower casing diameter. The tool is therefore flexible and can be used for a range of casing diameters.

Once the downhole tool is securely gripping the casing the tool may be retrieved thereby lifting the cut casing section out of the wellbore.

FIG. 1A to 3 describe the tool when positioned as an end tool on a tool string. However, the tool may be located on a tool string above another tool.

Figure 4A:
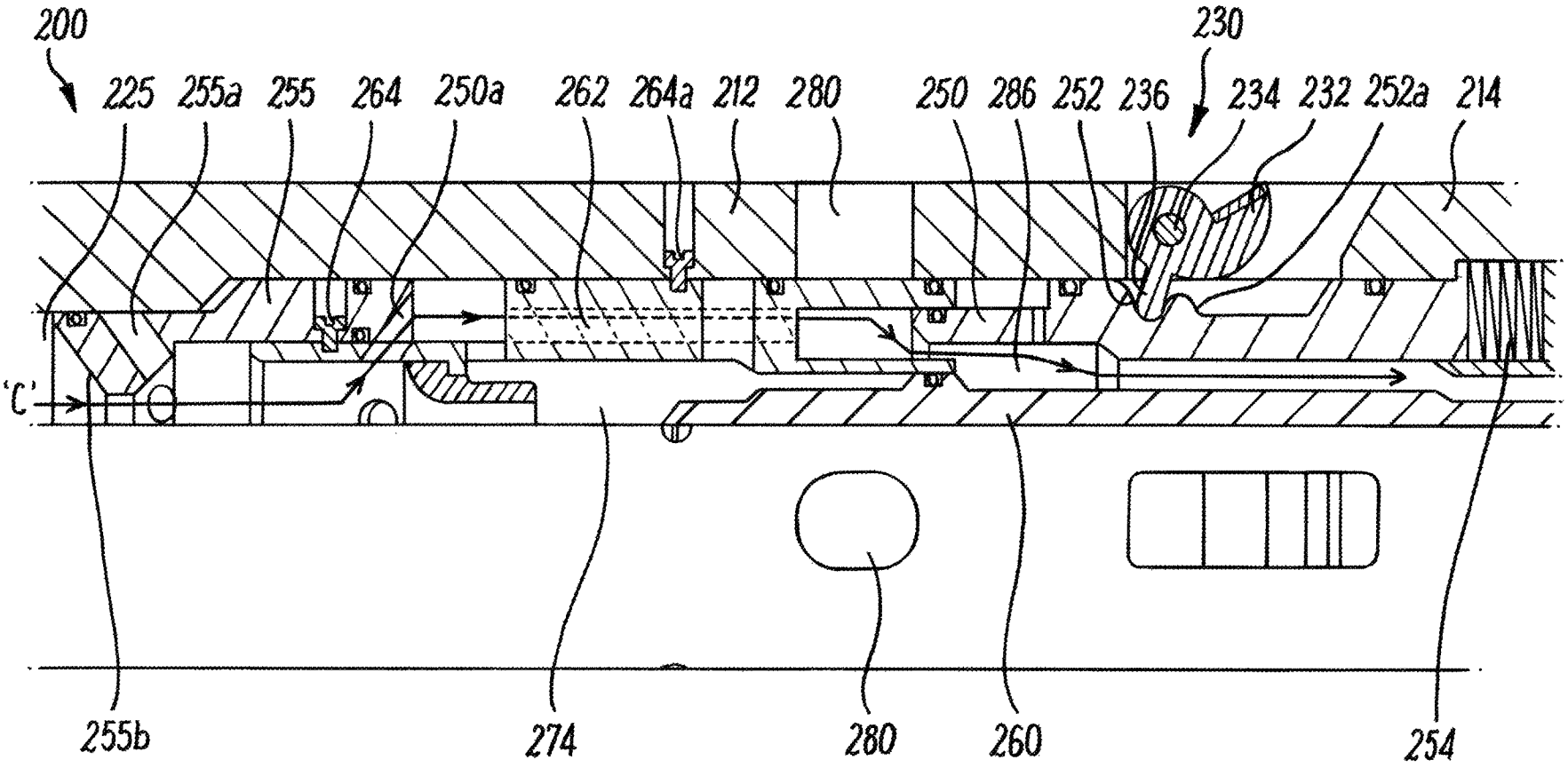
FIG. 4A is a longitudinal view through a downhole tool connected to a tool string in a deployed state according to another embodiment of the invention.
Figure 4B:
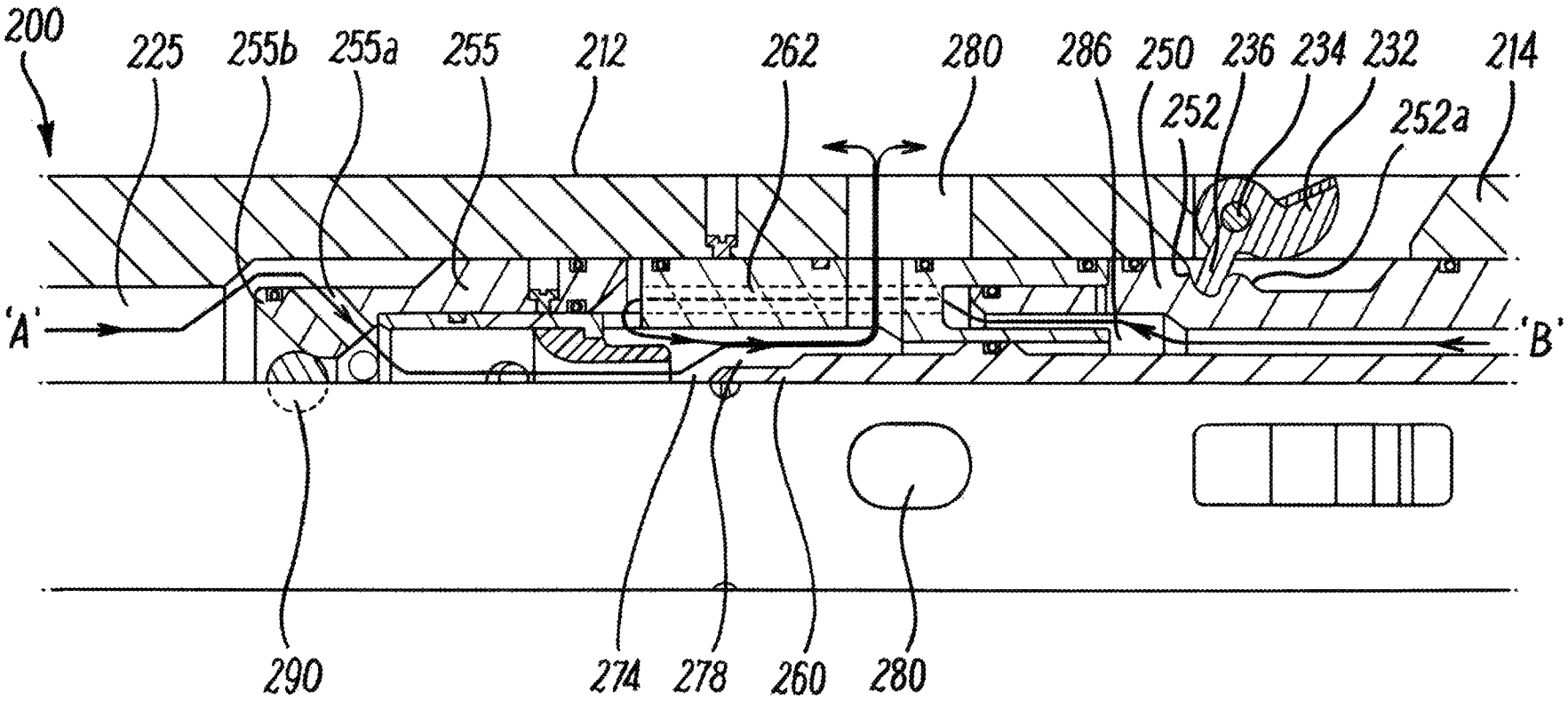
FIG. 4B is a longitudinal section through the downhole tool of FIG. 4A shown switched to an operational state.
Figure 4C:
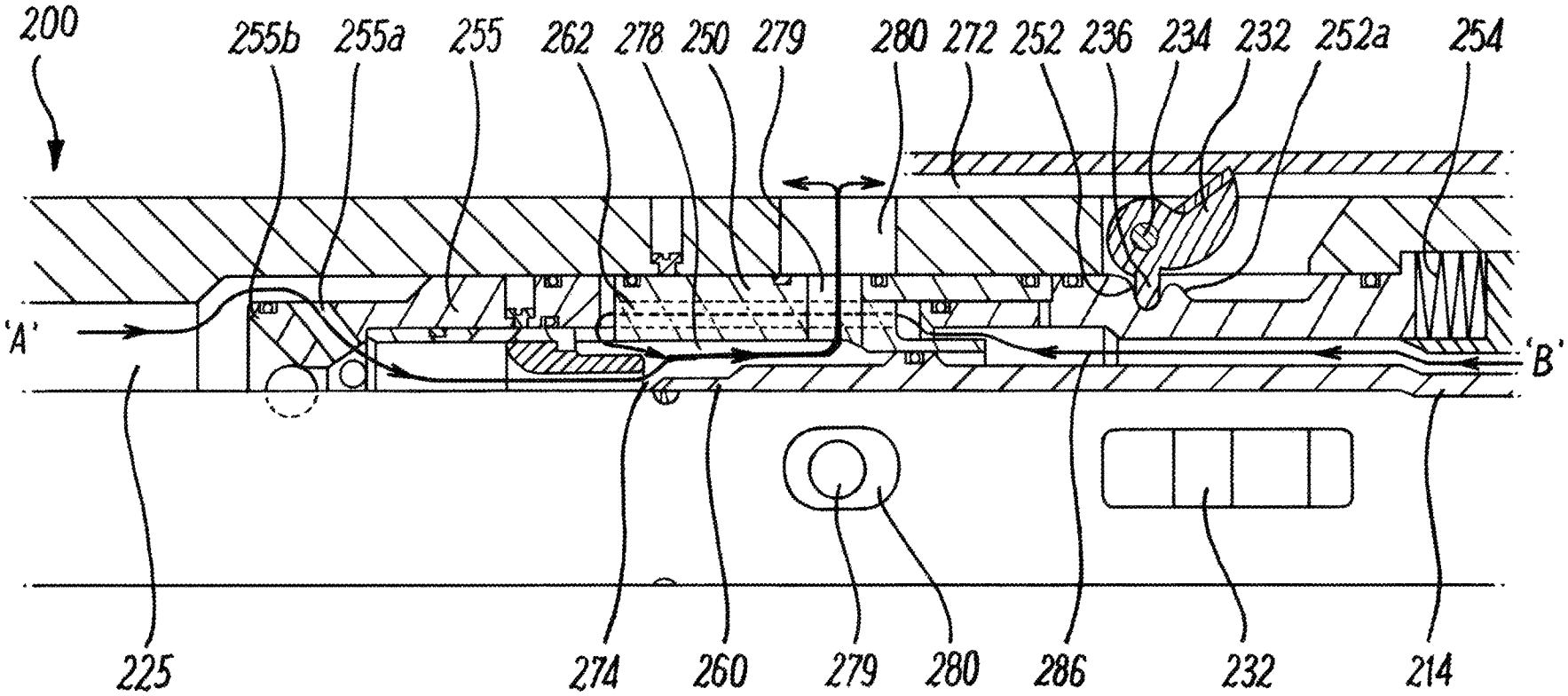
FIG. 4C is a longitudinal section through the downhole tool of FIG. 4A shown in a cutting state.

FIGS. 4A, 4B and 4C are longitudinal sectional views of a downhole tool when connected to a tool string in accordance with an embodiment of the invention in different phases of operation.

The tool 200 is similar to the tool 10 described in FIGS. 1A to 3 and will be understood from the descriptions of tool 10 above. However, the tool 200 described in FIGS. 4A, 4B and 4C is designed to be connected to a tool string with at least one hydraulically operable tool connected to the tool string.

FIG. 4A is a longitudinal section through the downhole tool 200. The gripping mechanism is not shown as its features and operation is the same as tool 10 and will be understood from the description of FIGS. 1A to 3 above. The downhole tool 200 has an elongate body 212 with a first end 214 and a second end (not shown). The first end 214 is designed for insertion into the wellbore first and is configured to be coupled to a lower tool string. The lower tool string may comprise at least one hydraulically operable tool connected to the tool string. The tool body 212 comprises a cutting mechanism 230 configured to cut a casing.

FIG. 4A shows the tool in a circulation mode where fluid flows through a circulation flow path through the tool.

An annular sleeve 250 is slidably mounted in the bore 225. The sleeve 250 is configured to move axially between a first position shown in FIG. 4A and second position shown in FIG. 4C. Intermediate positions may be selected as shown in FIG. 4B. The sleeve 250 comprises a shoulder 252 which is configured to engage with a pivot arm 236 connected to the cutting knife 232. The shoulder 252 of the sleeve 250 is configured to pivotally move the knives 232 between a knife storage position shown in FIG. 4A and a knife deployed position shown in FIG. 4C.

An annular port closing sleeve 255 is slidably mounted in the bore 225. The port closing sleeve 255 is configured to move axially between a first position shown in FIG. 4A and second position shown in FIG. 4B. The annular port closing sleeve 255 is configured to engage sleeve annular sleeve 250 such that in a first position port 250*a* on the sleeve 250 is open and in a second position port 250*a* is closed.

The annular sleeve 250 comprises a bypass channel 262. The bypass channel 262 is in fluid communication with bore 225 through ports 250*a*. The annular sleeve 250 is movably mounted in the tool and is biased in a first position by a spring 254.

The annular port closing sleeve 255 is held in a first position relative to the body 212 by shear screws 264. The annular sleeve 250 is held in a first position relative to the body 212 by shear screws 264*a*. Fluid flowing through the upper tool string flows through the circulation flow path. Fluid flows from bore 225 through ports 250*a* into bypass channel 262. The flow continues through channel 286 into the lower tool string bore (not shown).

FIG. 4B shows the tool when switched to a cutting operation mode. In this tool mode the annular port closing sleeve 255 is moved to a second position where it blocks ports 250*a* on the sleeve 250 closing the circulation flow path. Ports 255*a* on the port closing sleeve 255 are opened allowing fluid flow through the first flow path denoted as "A" in FIG. 4B.

However, in FIG. 4B there is not sufficient fluid flow through the first flow path to operate the cutting mechanism.

A fluid displacement member 260 is disposed in the bore 225 and is configured to introduce a pressure difference in the fluid upstream of the displacement member and the fluid downstream of the displacement member 260.

When the tool is switched to a cutting operation mode the bore 225 is in fluid communication with the annular space 272 through a first flow path denoted by arrow "A" in FIG. 4B. The first flow path comprises ports 255*a*, channel 278 located between the sleeve 250 and the displacement member 260, a port 279 in the sleeve 250, an outlet 280 in the body 212 and into the annular space 272. The fluid displacement member 260 acts to direct the fluid into channel 278.

FIG. 4C shows the tool during a cutting operation. Fluid flows through the first flow path to actuated the cutter mechanism.

The sleeve 250 is configured to be moved from a knife retracted position shown in FIG. 4B to a knife deployed position shown in FIG. 4C when fluid pressure is applied to shoulder 255*b* of the sleeve 255. When fluid pressure applied to shoulder 255*b* is sufficient to overcome the spring force of spring 254 the sleeve 250 moves toward the first end 214 of the tool. The fluid displacement member 260 remains stationary.

In FIG. 4C the annular sleeve 250 is located in a knife deployed position wherein the flow area of the nozzle 274 is reduced by the movement of the sleeve 250 toward end 214. The reduced flow area increases the fluid pressure through the nozzle 274. Measuring and/or monitoring the fluid pressure through the nozzle 274 may provide an indication of the movement of the annular sleeve 250 and the movement of the knives to a cutting operational position as shown in FIG. 2A.

FIG. 4C shows that the tool 200 comprises a second flow path denoted by arrow "B". The fluid inlet of the second flow path is a port (not shown) located on the lower tool string or a tool located on the lower tool string.

The second flow path passes through a channel 286 in the annular sleeve 250 and into a channel 278 located between the sleeve 250 and the displacement member 270. In channel 278 the fluid from the second flow path joins the fluid passing through the first flow path. The fluid exits the tool body into the annular space 272 via port 279 in the sleeve 250 and through an outlet 280 in the body 212 and into the annular space 272.

Optionally, the second flow path may comprise a screen to prevent casing cutting and solids from entering the downhole tool via the second flow path.

The outlet 280 is dimensioned such that it is larger than the port 279 on the sleeve 250. This is to ensure that fluid flow through port 279 and outlet 280 is maintained as the sleeve moves between the first and second positions shown in FIGS. 4A and 4C. This provides an axially moveable venturi flow path which moves as the axial position of the sleeve 250 moves.

Operation of the cutting apparatus will now be described with reference to FIGS. 4A, 4B and 4C. In FIG. 4A, the cutting and pulling downhole tool 200 is shown in a tool run in phase, with the cutting mechanism 230 in a retracted storage position. The tool 200 in the run in phase is lowered in the downhole to a desired position where the casing is to be cut.

Once the tool is at a desired position the grip mechanism is actuated to grip the casing diameter as described in relation to FIGS. 1A to 3.

The fluid pumped into bore 225 enters the circulation flow path of the cutting mechanism denoted as arrow "C" in FIG. 4A. The circulation flow path consists of port 250*a* on the sleeve 250 and bypass channel 262 which is in fluid communication with the lower tool-string through bore. The fluid flows in the through bore of the tool string and may be used to actuate at least one downstream hydraulic tool. Fluid flow through the circulation flow path does not actuate the knives and they remain in a retracted position as shown in FIG. 4A.

By proving a circulation flow path which bypasses the actuating of the cutting mechanism in the tool may allow a high fluid flow rate to be pumped through the tool. The tool may also allow the transfer torque to a downstream tool such as a drill bit or mill without actuating the cutting mechanism.

In order to switch the tool to a cutting operation position as shown in FIG. 4B, a ball 290 is dropped in the bore of the tool string and is carried by fluid flow through bore 225 until it is retained by the shoulder 255*b* of the port closing sleeve. Fluid pressure acts on the ball sheering screws 264, 264*a* and moves the port closing sleeve 255 and sleeve 250 to a second position where ports 250*a* on the sleeve 250 are closed and ports 255*a* on the port closing sleeve 255 are opened. This closes the circulation path "C" and opens a first flow path denoted by arrow "A" in FIG. 4B.

The first flow path passes from the bore 225 through ports 255*b*, through a channel 278 located between the sleeve 250 and the displacement member 260, a port 279 in the sleeve 250 and through an outlet 280 in the body 212 and into the annular space 272. FIG. 4C show the actuation of the cutting mechanism when the tool in a cutting operation position. Fluid is pumped into the tool string and flows through the first flow path to actuate the cutting mechanism.

During the cutting operation the grip mechanism remains substantially stationary relative to the cutting mechanism.

The fluid pumped into bore 225 acts against shoulder 255*a* of the port closing sleeve 255. When the fluid pressure is sufficient to overcome the spring force of spring 254 the port closing sleeve 255 and sleeve 250 are moved towards end 214 of the downhole tool. Axial movement of the sleeve 250 towards first end 214 of the tool causes shoulder 252 of the sleeve 250 to acts against the pivot arm 236 to rotate the knife 232 from a retracted storage position to an extended operational position.

FIG. 4C shows that the tool 200 comprises a second flow path denoted by arrow "B". The fluid inlet of the second flow path is port (not shown) located on the lower tool string or a tool located on the lower tool string.

The second flow path passes from a bore of a lower tool string (not shown) to channel 286 in the annular sleeve 250 through channel 262 and into a channel 278 located between the sleeve 250 and the displacement member 260. In channel 278 the fluid from the second flow path joins the fluid passing through the first flow path. The fluid exits the tool body into the annular space 272 via port 279 in the sleeve 250 and through an outlet 280 in the body 212 and into the annular space 272.

The first flow path and the second flow path are in fluid communication in channel 278 located between the sleeve 250 and the displacement member 260. Fluid flowing through channel 278 along the first flow path induces a venturi effect in the second flow path denoted by arrow "B" in FIG. 4C and draws fluid up through the lower tool string and through the second flow path.

Fluid flow through the first flow path directs fluid flow into the annular space 272. As the flow through the first flow path creates a venturi effect in the second flow path and induces fluid flow in the second flow path from the bore of a lower tool string (not shown) it creates a localised recirculation of fluid.

The bore of lower tool string and/or a tool connected to the lower tool string may have ports in fluid communication with the annular space. The recirculation of fluid directs the flow of fluid from the outlet 280 which entrains cuttings during the cutting operation and moves the fluid and cuttings further downhole toward the ports on the lower tool string and/or a tool. This action allows the cuttings to be moved further downhole away from the cutting site.

The axially moveable venturi flow path provides a driving force to actuate the cutting mechanism and induces localised recirculation of fluid around the tool to ensure that the casing cuttings are removed from the cutting site.

Fluid flowing in the second flow path exits into the first flow path. In this configuration, the arrangement of the first and second flow paths allows a recirculation of fluid. When the cutting mechanism has finished cutting the casing, the cutting mechanism is deactivated. The rotation the tool string is stopped to stop the rotation of the cutting mechanism. Optionally, the fluid pump is deactivated. The absence of fluid pressure on the shoulder 255*a* of the sleeve 255 causes the spring force of spring 254 to act on the sleeve 250 to move the sleeve 250 to a position shown in FIG. 4B. The movement of the sleeve moves the shoulder 252*a* to engage the pivot arm 236 to rotate the knives to a retracted position.

After the casing is cut, the cut casing section may be removed from the wellbore. It is difficult to know when the cutting operation has been completed. There are a number of indicators that suggest that the casing has been cut. A pressure change measured at nozzle 274 indicates that the sleeve 250 has been moved and that knives 322 have been successfully deployed to an extended operational position.

Another indicator is a change in the force required to rotate the cutting mechanism. This suggests that the casing has been cut and the resistance against the knives is reduced. A further method of determining whether the casing has been cut is to apply an upward force on the tool while it is still gripping the casing. If there is movement of the casing the cut has been successful.

Throughout the specification, unless the context demands otherwise, the terms 'comprise' or 'include', or variations such as 'comprises' or 'comprising', 'includes' or 'including' will be understood to imply the inclusion of a stated integer or group of integers, but not the exclusion of any other integer or group of integers. Furthermore, relative terms such as", "lower", "upper", "above", "below", "up", "down" and the like are used herein to indicate directions and locations as they apply to the appended drawings and will not be construed as limiting the invention and features thereof to particular arrangements or orientations. Likewise, the term "inlet" shall be construed as being an opening which, dependent on the direction of the movement of a fluid may also serve as an "outlet", and vice versa.

The invention provides a downhole tool for cutting a wellbore casing. The tool comprises a gripping mechanism for gripping a section of wellbore casing and a cutting mechanism configured to cut the casing. The grip mechanism is configured to grip multiple casing diameters.

The present invention obviates or at least mitigates disadvantages of prior art downhole tools and provides a robust, reliable and compact downhole tool suitable for cutting and removing downhole casing. The invention enables the tool to cut and grip a variety of casing diameters in a single downhole trip. The resulting downhole tool has improved productivity and efficiency, and is capable of reliably performing multiple gripping and cutting actions once deployed downhole.

A further benefit of the downhole tool is that it may be used on a tool string with at least one other hydraulically operable tool. This may allow multiple downhole tasks to be performed in a single trip such as a drilling operation followed by gripping and cutting the casing.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A downhole tool for cutting and removing a wellbore casing comprising:

a tool body;

a cutting mechanism configured to cut the casing;

a gripping mechanism comprising:

a cone and at least one slip;

the cone being circumferentially disposed about a section of the downhole tool and having a cone slope;

the at least one slip being arranged on the cone slope and configured to engage a surface of the inside diameter of the casing by being pushed along the cone slope in a first direction while bearing against the cone to anchor the tool to the casing when operating the cutting mechanism and when removing the casing;

wherein an angle of the cone slope is configured so that the gripping mechanism grips casing of a first and a second inside diameter;

wherein the grip mechanism is resettable for positioning and gripping the casing of the first inside diameter at a first location and gripping the casing of the second inside diameter at a second location within the wellbore.

2. The downhole tool according to claim 1 wherein the gripping mechanism is actuated by pumping fluid into a throughbore in the tool body.

3. The downhole tool according to claim 1 wherein the gripping mechanism comprises a sleeve configured to be movably mounted within the tool body, the sleeve being configured to move the at least one slip between a first position where the at least one slip does not engage the casing and a second position where the at least one slip engages the casing and wherein the sleeve of the gripping mechanism is configured to move in response to fluid pressure acting on at least part of the sleeve.

4. The downhole tool according to claim 1 wherein the gripping mechanism comprises a lock mechanism to prevent accidental release of the gripping mechanism.

5. The downhole tool according to claim 1 wherein the cutting mechanism comprises a plurality of knives and a sleeve configured to be axially moveable within the tool body in response to fluid pressure acting on at least a part of the sleeve and wherein the cutting mechanism sleeve is configured to move the knives between a storage position where the knives are retracted and do not engage the casing and an operational position where the knives are extended and engage the casing.

6. The downhole tool according to claim 1 wherein the cutting mechanism is actuated by pumping fluid into a throughbore of the tool.

7. The downhole tool according to claim 1 wherein a fluid displacement member is disposed in a throughbore of the cutting mechanism and is configured to introduce a pressure difference in the fluid upstream of the displacement member and the fluid downstream of the displacement member wherein the fluid displacement member provides a restriction and/or nozzle in a flow path of the cutting mechanism forming a venturi flow path.

8. The downhole tool according to claim 7 wherein the venturi flow path is axially moveable in the tool body.

9. The downhole tool according to claim 7 wherein the cutting mechanism comprises a recirculating flow path configured to direct fluid flow and/or casing cuttings created by the cutting operation to a location away from the cutting site wherein the recirculating flow path comprises a first flow path extending between a throughbore in the tool body and the annulus of the wellbore and a second flow path extending between an opening on a lower end of the tool body and the throughbore of the tool body, wherein the first flow path and the second flow path are in fluid communication in a channel in the tool body, the first flow path configured to draw fluid through the second flow path and the fluid flowing through the first flow path actuates the cutting mechanism.

10. The downhole tool according claim 1 comprising a bypass flow path around the cutting mechanism wherein the bypass flow path is selectively openable and/or closable.

11. The downhole tool according to claim 1 wherein the gripping mechanism and the cutting mechanism are arranged adjacently on the downhole tool to mitigate vibration effects or chattering on the downhole tool.

12. A method of cutting a wellbore casing comprising providing a downhole tool comprising:

a tool body;

a gripping mechanism configured to be adjustably set to grip a range of casing diameters, the gripping mechanism comprising:

a cone and at least one slip:

the cone being circumferentially disposed about a section of the downhole tool and having a cone slope;

the at least one slip being arranged on the cone slope and configured to engage a surface of the inside diameter of the casing by being pushed along the cone slope in a first direction while bearing against the cone; and a cutting mechanism configured to cut the casing;

lowering the downhole tool into a wellbore to a first desired depth;

actuating the grip mechanism to grip the casing by pushing the at least one slip along the cone slope in the first direction while bearing against the cone;

pulling the downhole tool toward the surface in a second direction opposite the first direction so that the grip mechanism holds the casing in tension;

actuating the cutting mechanism to cut the casing in tension;

releasing the grip mechanism from the casing after the casing has been cut;

raising the downhole tool to a further desired depth;

actuating the grip mechanism to grip the casing at the further desired depth by pushing the at least one slip along the cone slope in the first direction while bearing against the cone; and pulling the downhole tool toward the surface to remove the cut casing section from the wellbore by pulling the downhole tool toward the surface in the second direction.

13. The method according to claim 12 comprising actuating the grip mechanism by pushing the at least one slip along the cone slope in the first direction while bearing against the cone to grip a casing of different diameter at the further desired depth.

14. A method of cutting a wellbore casing comprising providing a tool string comprising a downhole tool and at least one hydraulically actuable tool, the downhole tool comprising:

a tool body;

a gripping mechanism comprising:

a single cone and at least one slip;

the single cone being circumferentially disposed about a section of the downhole tool and having a cone slope;

the at least one slip being arranged on the cone slope and configured to engage a surface of the inside diameter of the casing by being pushed along the cone slope in a first direction while bearing against the cone to anchor the tool to the casing when operating the cutting mechanism and when removing the casing;

wherein an angle of the cone slope is configured so that the gripping mechanism grips casing of a first and a second inside diameter;

wherein the grip mechanism is resettable for positioning and gripping the casing of the first inside diameter at a first location and gripping the casing of the second inside diameter at a second location within the wellbore;

a cutting mechanism configured to cut the casing;

a bypass flow path around the cutting mechanism; and a first flow path in fluid communication with the cutting mechanism lowering the tool string into a wellbore to a first desired depth;

actuating the grip mechanism to grip the casing by pushing the at least one slip along the cone slope in the first direction while bearing against the cone;

pumping fluid through the bypass flow path to actuate the at least one hydraulically actuable tool;

closing the bypass flow path and opening the first flow path;

actuating the cutting mechanism to cut the casing; and removing the cut casing section from the wellbore while pushing the at least one slip along the cone slope in the first direction while bearing against the cone.

15. A downhole tool for cutting a wellbore casing comprising:

a tool body;

a cutting mechanism configured to cut the casing;

a gripping mechanism comprising:

a cone and at least one slip;

the at least one slip configured to engage a surface of the inside diameter of the casing by bearing against the cone;

the cone being circumferentially disposed about a section of the downhole tool and having a cone slope-wherein an angle of the cone slope is configured so that the gripping mechanism grips casing of a first and a second inside diameter;

the grip mechanism is resettable for positioning and gripping the casing of the first inside diameter at a first location and gripping the casing of the second inside diameter at a second location within the wellbore;

a fluid displacement member is disposed in a throughbore of the cutting mechanism and is configured to introduce a pressure difference in the fluid upstream of the displacement member and the fluid downstream of the displacement member wherein the fluid displacement member provides a restriction and/or nozzle in a flow path of the cutting mechanism forming a venturi flow path; and the cutting mechanism comprises a recirculating flow path configured to direct fluid flow and/or casing cuttings created by the cutting operation to a location away from the cutting site wherein the recirculating flow path comprises a first flow path extending between a throughbore in the tool body and the annulus of the wellbore and a second flow path extending between an opening on a lower end of the tool body and the throughbore of the tool body, wherein the first flow path and the second flow path are in fluid communication in a channel in the tool body the first flow path configured to draw fluid through the second flow path and the fluid flowing through the first flow path actuates the cutting mechanism.

* * * * *